US009170567B2

(12) United States Patent
Kato

(10) Patent No.: US 9,170,567 B2
(45) Date of Patent: Oct. 27, 2015

(54) SATELLITE RADIO-CONTROLLED WRISTWATCH

(71) Applicants: CITIZEN HOLDINGS CO., LTD., Tokyo (JP); CITIZEN WATCH CO., LTD., Tokyo (JP)

(72) Inventor: Akira Kato, Sayama (JP)

(73) Assignees: CITIZEN HOLDINGS CO., LTD., Tokyo (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 14/413,704

(22) PCT Filed: Jul. 10, 2013

(86) PCT No.: PCT/JP2013/068907

§ 371 (c)(1),
(2) Date: Jan. 9, 2015

(87) PCT Pub. No.: WO2014/010644

PCT Pub. Date: Jan. 16, 2014

(65) Prior Publication Data

US 2015/0168924 A1 Jun. 18, 2015

(30) Foreign Application Priority Data

Jul. 11, 2012 (JP) ..... 2012-155972

(51) Int. Cl.
*G04R 20/04* (2013.01)
*G04R 60/14* (2013.01)

(52) U.S. Cl.
CPC ..... *G04R 20/04* (2013.01); *G04R 60/14* (2013.01)

(58) Field of Classification Search
CPC ..... G04R 20/00; G04R 20/02; G04R 20/04; G04R 60/14
USPC ..... 368/47
See application file for complete search history.

(56) References Cited

U.S. PATENT DOCUMENTS 5,883,594 A * 3/1999 Lau ..... 342/357.63
(Continued)

FOREIGN PATENT DOCUMENTS

| | | | |
|---|---|---|---|
| JP | 2009-053182 | A | 3/2009 |
| JP | 2010-060456 | A | 3/2010 |
| JP | 2011-043449 | A | 3/2011 |

OTHER PUBLICATIONS

The Quayle Action for U.S. Appl. No. 14/413,709 dated May 4, 2015.
(Continued)

*Primary Examiner* — Vit W Miska
(74) *Attorney, Agent, or Firm* — Hubbs, Enatsky & Inoue PLLC

(57) ABSTRACT

In a satellite radio-controlled wristwatch, a time to be spent on acquisition and tracking is reduced and also a reception success probability is increased. A satellite radio-controlled wristwatch according to the present invention includes: a satellite radio wave reception unit including an antenna for receiving a satellite radio wave, a high frequency circuit, and a decoder circuit; a clock circuit for holding and counting an internal time; and a controller for controlling timings of at least: an activation operation of supplying power to the satellite radio wave reception unit for activation thereof; an acquisition and tracking operation of acquiring and tracking a certain satellite radio wave by the satellite radio wave reception unit; and a time information acquisition operation of acquiring time information from the satellite radio wave received by the satellite radio wave reception unit, the controller being configured to: wait for arrival of an activation time point, which is inversely calculated by subtracting an acquisition and tracking time period and an activation time period from a time information receivable time point that is predicted based on the internal time, and then start the activation operation; and vary the acquisition and tracking time period depending on a predetermined condition.

8 Claims, 11 Drawing Sheets

(56) References Cited

U.S. PATENT DOCUMENTS

| | | | | |
|---|---|---|---|---|
| 2003/0198140 | A1* | 10/2003 | Shimizu | 368/47 |
| 2007/0063890 | A1* | 3/2007 | Yu | 342/357.02 |
| 2008/0025151 | A1 | 1/2008 | Urano et al. | |
| 2008/0175105 | A1 | 7/2008 | Urano et al. | |
| 2009/0015470 | A1 | 1/2009 | Fujisawa | |
| 2009/0034372 | A1* | 2/2009 | Fujisawa | 368/14 |
| 2010/0054087 | A1* | 3/2010 | Matsuzaki | 368/14 |

OTHER PUBLICATIONS

International Search Report for PCT/JP2013/068907 dated Aug. 20, 2013.

Office Action for relating U.S. Appl. No. 14/413,703 dated Jul. 8, 2015.

* cited by examiner

FIG.4

SUBFRAME 1

| WORD | BIT POSITION | BIT COUNT | CONTENT | |
|---|---|---|---|---|
| 1 | 1 | 22 | TLM | TELEMETRY WORD |
| 2 | 31 | 22 | HOW | HANDOVER WORD |
| 3 | 61 | 10 | WN | WEEK NUMBER |
| | 73 | 4 | URA | RANGE ACCURACY |
| | 77 | 6 | SVhealth | SATELLITE HEALTH STATE |
| | 83 | 2 MSB | 10DC | CLOCK INFORMATION NUMBER |
| 7 | 197 | 8 | TGD | GROUP DELAY |
| 8 | 211 | 8 LSB | 10DC | CLOCK INFORMATION NUMBER |
| | 219 | 16 | toc | EPOCH TIME (CLOCK) |
| 9 | 241 | 8 | af2 | CLOCK CORRECTION COEFFICIENT |
| | 249 | 16 | af1 | CLOCK CORRECTION COEFFICIENT |
| 10 | 271 | 22 | af0 | CLOCK CORRECTION COEFFICIENT |

SATELLITE RADIO-CONTROLLED WRISTWATCH

CROSS REFERENCE TO RELATED APPLICATIONS

This application is a National Stage of International Application No. PCT/JP2013/068907 filed Jul. 10, 2013, claiming priority based on Japanese Patent Application No. 2012-155972 filed on Jul. 11, 2012. The contents of each of the above documents are incorporated herein by reference in their entirety.

TECHNICAL FIELD

The present invention relates to a satellite radio-controlled wristwatch.

BACKGROUND ART

There has been proposed a radio-controlled wristwatch (hereinafter referred to as "satellite radio-controlled wristwatch") configured to receive a radio wave (hereinafter referred to as "satellite radio wave") from an artificial satellite used for a positioning system, such as a Global Positioning System (GPS) satellite, to thereby adjust time. Such adjustment is possible because positioning signals typified by a GPS signal contain accurate time information. An ultra-high frequency wave is used for such a satellite radio wave, and hence a larger amount of information is sent per hour as compared to a low frequency wave used for a standard radio wave, which has been used in the related art for time adjustment on the ground. As a result, the time required for reception of the time information is considered to be reduced as compared to the case where the standard radio wave is received.

In Patent Literature 1, there is disclosed a GPS-equipped wristwatch corresponding to the satellite radio-controlled wristwatch.

CITATION LIST

Patent Literature

[Patent Literature 1] JP 2011-43449 A

SUMMARY OF INVENTION

Technical Problem

In order to receive the satellite radio wave that is an ultra-high frequency wave, operation of a high frequency circuit is necessary, but this circuit requires an extremely high operating frequency, which causes large power consumption. Therefore, in order to suppress the power consumption and increase the operation duration of the satellite radio-controlled wristwatch, it is desired that the operating time of the high frequency circuit be set as short as possible. On the other hand, in order to receive the satellite radio wave that is a weak radio wave, an operation called acquisition and tracking of the satellite radio wave is necessary so as to detect a radio wave with receivable intensity among multiple-transmitted satellite radio waves. As the more time is spent on the acquisition and tracking, the more reliable reception can be expected. In view of this, when a sufficient time is spent on the acquisition and tracking, the reception success probability increases, but the power consumption increases. On the other hand, when the time spent on the acquisition and tracking is insufficient, the reception fails, which requires reception again, eventually resulting in the increase in power consumption. Further, in any of the cases, the entire reception time increases, which gives a user an impression that the reception is slow. Further, even if an attempt is made to set an optimal value for the time to be spent on the acquisition and tracking, the wristwatch is worn and carried on the user's wrist, and hence the radio wave environment is variable. Therefore, it is difficult to suppress the power consumption and reduce the entire reception time regardless of any determination of the time to be spent on the acquisition and tracking.

The present invention has been made in view of the above-mentioned circumferences, and has an object to reduce the time to be spent on the acquisition and tracking and also increase the reception success probability in the satellite radio-controlled wristwatch.

Solution to Problem

The invention disclosed in this application to achieve the above-mentioned object has various aspects, and the representative aspects are outlined as follows.

(1) A satellite radio-controlled wristwatch, including: a satellite radio wave reception unit including an antenna for receiving a satellite radio wave, a high frequency circuit, and a decoder circuit; a clock circuit for holding and counting an internal time; and a controller for controlling timings of at least: an activation operation of supplying power to the satellite radio wave reception unit for activation thereof; an acquisition and tracking operation of acquiring and tracking a certain satellite radio wave by the satellite radio wave reception unit; and a time information acquisition operation of acquiring time information from the satellite radio wave received by the satellite radio wave reception unit, the controller being configured to: wait for arrival of an activation time point, which is inversely calculated by subtracting an acquisition and tracking time period and an activation time period from a time information receivable time point that is predicted based on the internal time, and then start the activation operation; and vary the acquisition and tracking time period depending on a predetermined condition.

(2) The satellite radio-controlled wristwatch according to Item (1), in which the predetermined condition is a condition relating to one or a plurality of information selected from whether automatic reception or manual reception is carried out, a position of a hand, a power supply voltage, whether or not a power supply is charged, a reception history, whether or not time is manually adjusted, an attitude of the satellite radio-controlled wristwatch, movement of the satellite radio-controlled wristwatch, illuminance around the satellite radio-controlled wristwatch, and a position of the satellite radio-controlled wristwatch.

(3) The satellite radio-controlled wristwatch according to Item (1) or (2), in which the controller selects one of a plurality of predetermined time periods as the acquisition and tracking time period depending on the predetermined condition.

(4) The satellite radio-controlled wristwatch according to Item (3), in which the controller selects, as the acquisition and tracking time period, any one of a first acquisition and tracking time period and a second acquisition and tracking time period longer than the first acquisition and tracking time period.

(5) The satellite radio-controlled wristwatch according to Item (4), further including a reception indication member for indicating at least that a first reception operation is in progress and a second reception operation is in progress, in which the controller causes the reception indication member to indicate that the first reception operation is in progress when the first acquisition and tracking time period is selected as the acquisition and tracking time period, and causes the reception indication member to indicate that the second reception operation is in progress when the second acquisition and tracking time period is selected as the acquisition and tracking time period.

(6) The satellite radio-controlled wristwatch according to Item (4) or (5), in which the controller selects the first acquisition and tracking time period when a user selects manual reception, a position of a hand is not overlapped with the antenna in a plan view, a power supply voltage is equal to or more than a predetermined threshold voltage, and reception has succeeded in each of a previous predetermined number of times.

(7) The satellite radio-controlled wristwatch according to any one of Items (1) to (6), further including a positioning unit for measuring a position of the satellite radio-controlled wristwatch, or a position information reception unit for receiving information relating to the position of the satellite radio-controlled wristwatch from a user, in which the predetermined condition includes a condition relating to latitude of the position of the satellite radio-controlled wristwatch.

(8) The satellite radio-controlled wristwatch according to Item (7), in which the predetermined condition further includes a condition relating to an elevation angle of an artificial satellite, which is predicted based on the position of the satellite radio-controlled wristwatch.

Advantageous Effects of Invention

According to the aspects of Items (1) to (4) and (6) to (8), in the satellite radio-controlled wristwatch, the time to be spent on the acquisition and tracking may be reduced and also the reception success probability may be increased.

Further, according to the aspect of Item (5), the user may be notified of whether the satellite radio-controlled wristwatch carries out an operation placing priority on short-time reception or an operation placing priority on reception success probability.

BRIEF DESCRIPTION OF DRAWINGS

FIG. 4 is a table showing the structure of subframe 1.

DESCRIPTION OF EMBODIMENTS

Figure 1:
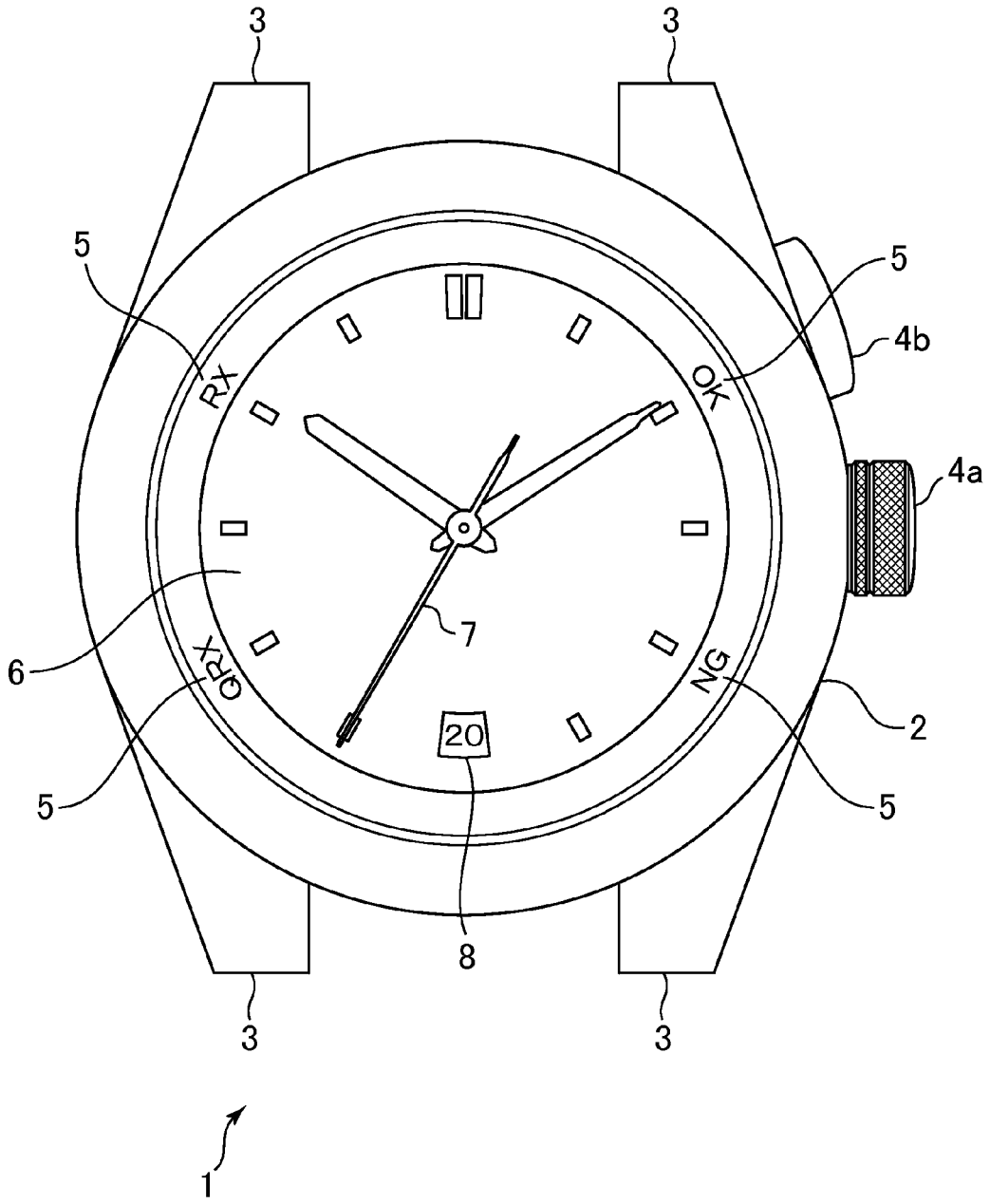
FIG. 1 is a plan view illustrating a satellite radio-controlled wristwatch according to an embodiment of the present invention.

FIG. 1 is a plan view illustrating a satellite radio-controlled wristwatch 1 according to an embodiment of the present invention. As described above, the satellite radio-controlled wristwatch as used herein refers to one type of radio-controlled wristwatches that are wristwatches having a function of receiving an external radio wave to adjust the time held inside the watch to an accurate time, which is configured to receive a satellite radio wave to adjust the time. Note that, the satellite radio-controlled wristwatch 1 according to this embodiment receives a radio wave (L1 wave) from a GPS satellite as the satellite radio wave.

In FIG. 1, reference numeral 2 denotes an exterior case, and band attachment portions 3 are provided to be opposed in the 12 o'clock direction and the 6 o'clock direction. Further, a crown 4*a* and a push button 4*b* serving as operating members are provided on a side surface of the satellite radio-controlled wristwatch 1 on the 3 o'clock side. Note that, in FIG. 1, the 12 o'clock direction of the satellite radio-controlled wristwatch 1 is an upward direction of FIG. 1, and the 6 o'clock direction is a downward direction of FIG. 1.

The satellite radio-controlled wristwatch 1 uses a hand mechanism as illustrated in FIG. 1, in which an hour hand, a minute hand, and a second hand are coaxially provided, with the central position of the satellite radio-controlled wristwatch 1 as the rotation center. Note that, although the second hand in this embodiment is coaxial with the hour and minute hands, the second hand may be replaced with a so-called chronograph hand and the second hand may be arranged at an arbitrary position as a secondary hand as exemplified by a chronograph watch. Then, position indications 5 of symbols "OK", "NG", "QRX", and "RX" are marked or printed on the exterior case 2 at appropriate positions outside a watch face 6. Those characters notify the user of various reception states of the satellite radio-controlled wristwatch 1 by causing the second hand to rotate and move to point to any one of those position indications 5 during or around the reception of the satellite radio wave by the satellite radio-controlled wristwatch 1. Therefore, the secondhand is also a reception indication member 7 for indicating, to the user, various reception states of the satellite radio-controlled wristwatch 1. Note that, the respective position indications 5 herein have the following meanings. That is, symbols "QRX" and "RX" mean that reception is in progress, symbol "OK" means that the reception has succeeded, and symbol "NG" means that the reception has failed. Note that, in this embodiment, there are two kinds of indications, "QRX" and "RX", for indicating that the reception is in progress because the satellite radio-controlled wristwatch 1 carries out two kinds of reception operations, specifically, a first reception operation and a second reception operation. Symbol "QRX" means that the first reception operation is in progress, while symbol "QX" means that the second reception operation is in progress. Details of the first reception operation and the second reception operation are described later.

Further, a date window 8 is provided at the 6 o'clock position of the watch face 6, and date can be visually recognized based on a position of a day dial shown through the date window 8. Note that, the date window 8 is merely an example and date display by an appropriate mechanism may be provided at an appropriate position. For example, in addition to the date display using the day dial or another rotating disk, day-of-week display and various kinds of indication using a secondary hand may be used. Alternatively, display by an electronic display device such as a liquid crystal display device may be used. In any case, the satellite radio-controlled wristwatch 1 internally holds at least information on the current date as well as the current time.

The satellite radio-controlled wristwatch 1 according to this embodiment further includes a patch antenna serving as a high frequency receiving antenna on the rear side of the watch face 6 at a position on the 9 o'clock side. Note that, the form of the antenna may be determined in accordance with the radio wave to be received, and an antenna of another form such as an inverted-F antenna may be used.

Figure 2:
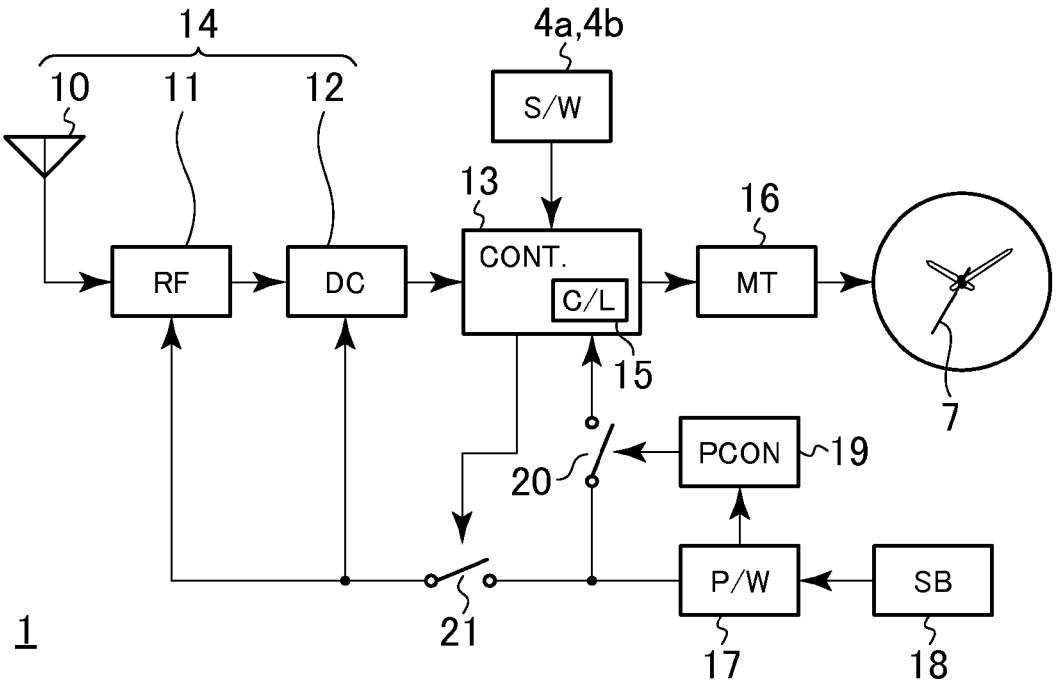
FIG. 2 is a functional block diagram of the satellite radio-controlled wristwatch according to the embodiment of the present invention.

FIG. 2 is a functional block diagram of the satellite radio-controlled wristwatch 1 according to this embodiment. A satellite radio wave is received by an antenna 10 and converted into a base band signal by a high frequency circuit 11. After that, various kinds of information contained in the satellite radio wave is extracted by a decoder circuit 12. The extracted information is transferred to a controller 13. In this case, the antenna 10, the high frequency circuit 11, and the decoder circuit 12 construct a satellite radio wave reception unit 14 for receiving a satellite radio wave and extracting information. The satellite radio wave reception unit 14 receives the satellite radio wave that is an ultra-high frequency wave and extracts the information, and hence operates at a high frequency.

The controller 13 is a microcomputer for controlling the entire operation of the satellite radio-controlled wristwatch 1, and includes a clock circuit 15 therein, thereby having a function of counting the internal time, which is the time held by the clock circuit 15. The accuracy of the clock circuit 15 is about ±15 seconds per month although varying depending on the accuracy of a crystal oscillator to be used or the use environment such as temperature. It should be understood that the accuracy of the clock circuit 15 can be set arbitrarily as necessary. Further, the controller 13 appropriately adjusts the internal time held by the clock circuit 15 as necessary, to thereby keep the internal time accurate. The controller 13 is only required to have a response speed necessary for responding to counting and a user's operation. Therefore, the controller 13 operates at a lower frequency than that of the above-mentioned satellite radio wave reception unit 14, and hence its power consumption is small.

The controller 13 inputs a signal from the operating member (crown 4*a*, push button 4*b*, or the like) so that the operation by the user can be detected. Further, the controller 13 outputs a signal for driving a motor 16 based on the internal time, to thereby drive the hands to indicate the time. Further, necessary indication is given to the user by the reception indication member 7. Note that, in this embodiment, the reception indication member 7 is the second hand, but the present invention is not limited thereto. Another hand or another member such as a disk may be used. For example, a dedicated hand for indication of various functions may be used as the reception indication member. Alternatively, the respective hands may be independently driven so as to drive a plurality of hands, for example, the hour hand and the minute hand in an overlapped manner, thereby using the hands as the reception indication member. Still alternatively, the motion speed and the motion mode (intermittent drive, movement of the second hand at two-second intervals, or the like) of a hand may differ from those in normal hand motion, to thereby use the hand as the reception indication member. Further, an electronic display member such as a liquid crystal display device may be used as the reception indication member.

The satellite radio-controlled wristwatch 1 further includes, as its power supply, a battery 17 that is a secondary battery such as a lithium-ion battery. The battery 17 accumulates electric power obtained by power generation of a solar battery 18 arranged on or under the watch face 6 (see FIG. 1). Then, the battery 17 supplies electric power to the high frequency circuit 11, the decoder circuit 12, and the controller 13.

A power supply circuit 19 monitors an output voltage of the battery 17. When the output voltage of the battery 17 decreases to be lower than a predetermined threshold, the power supply circuit 19 turns off a switch 20 to stop the supply of power to the controller 13. In response thereto, the supply of power to the clock circuit 15 is also stopped. Thus, when the switch 20 is turned off, the internal time held by the clock circuit 15 is lost. Further, when the output voltage of the battery 17 is recovered due to the power generation of the solar battery 18 or the like, the power supply circuit 19 turns on the switch 20 to supply power to the controller 13, to thereby recover the functions of the satellite radio-controlled wristwatch 1. Further, a switch 21 is a switch for turning on or off the supply of power to the high frequency circuit 11 and the decoder circuit 12, and is controlled by the controller 13. The high frequency circuit 11 and the decoder circuit 12, which operate at a high frequency, are large in power consumption, and hence the controller 13 turns on the switch 21 to operate the high frequency circuit 11 and the decoder circuit 12 only when the radio wave is received from the satellite, and otherwise turns off the switch 21 to reduce power consumption.

The satellite radio wave may be received when a request is issued from a user through operation of the operating member such as the crown 4*a* or the push button 4*b* (hereinafter referred to as "manual reception"), or when a predetermined time has come (hereinafter referred to as "regular reception"). Alternatively, the satellite radio wave may be received based on an elapsed time from the time at which the previous time adjustment was made, or based on information representing the generated energy of the solar battery 18 or other information representing an ambient environment of the satellite radio-controlled wristwatch 1 (hereinafter referred to as "environmental reception"). Note that, as a term opposed to "manual reception", the regular reception and the environmental reception are collectively referred to as "automatic reception".

Subsequently, a description is given of a signal from a GPS satellite received by the satellite radio-controlled wristwatch 1 according to this embodiment. The signal transmitted from the GPS satellite has a carrier frequency of 1,575.42 MHz called "$L_1$ band". The signal is encoded by a C/A code specific to each GPS satellite modulated by binary phase shift keying (BPSK) at a period of 1.023 MHz, and is multiplexed by a so-called code division multiple access (CDMA) method. The C/A code itself has a 1,023-bit length, and message data on the signal changes every 20 C/A codes. In other words, 1-bit information is transmitted as a signal of 20 ms.

Figure 3:
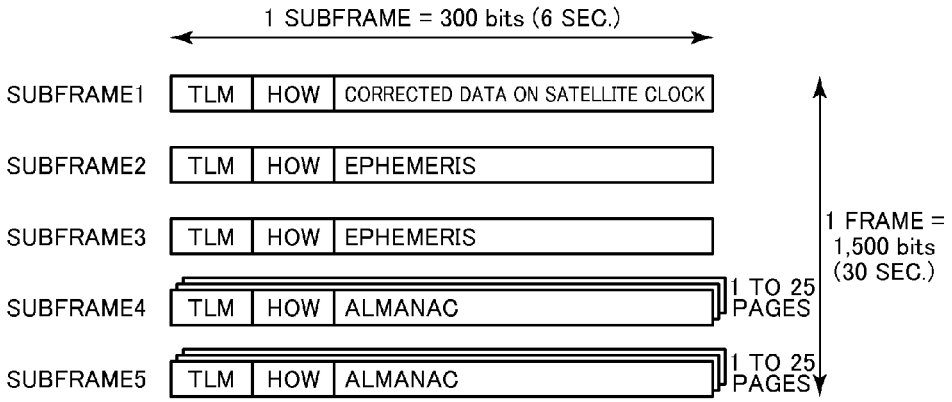
FIG. 3 is a schematic diagram illustrating the structure of subframes of a signal transmitted from a GPS satellite.

The signal transmitted from the GPS satellite is divided into frames having a unit of 1,500 bits, namely 30 seconds, and each frame is further divided into five subframes. FIG. 3 is a schematic diagram illustrating the structure of subframes of the signal transmitted from the GPS satellite. Each subframe is a signal of 6 seconds containing 300-bit information. The subframes are numbered 1 to 5 in order. The GPS satellite transmits the subframes sequentially starting from subframe 1. When finishing the transmission of subframe 5, the GPS satellite returns to the transmission of subframe 1 again, and repeats the same process thereafter.

At the head of each subframe, a telemetry word represented by TLM is transmitted. TLM contains a preamble that is a code indicating the head of each subframe, and information on a ground control station. Subsequently, a handover word represented by HOW is transmitted. HOW contains TOW as information relating to the current time, also called "Z count". TOW is a 6-second-unit time counted from 0:00 AM on Sunday at GPS time, and indicates a time at which the next subframe is started.

Information following HOW differs depending on the subframe, and subframe 1 includes corrected data of a satellite clock. FIG. 4 is a table showing the structure of subframe 1. Subframe 1 includes a week number represented by WN following HOW. WN is a numerical value indicating a current week counted by assuming Jan. 6, 1980 as a week 0. Accordingly, by receiving both WN and TOW, accurate day and time at the GPS time can be obtained. Note that, once the reception of WN is succeeded, an accurate value can be known through counting of the internal time unless the satellite radio-controlled wristwatch 1 loses the internal time for some reason, for example, running out of the battery. Therefore, re-reception is not always necessary. Note that, as described above, WN is 10-bit information and hence is returned to 0 again when 1,024 weeks has elapsed. Further, the signal from the GPS satellite contains other various kinds of information, but information not directly relating to the present invention is merely shown and its description is omitted.

Referring to FIG. 3 again, subframe 2 and subframe 3 contain orbit information on each satellite called "ephemeris" following HOW, but its description is herein omitted.

In addition, subframes 4 and 5 contain general orbit information for all the GPS satellites called "almanac" following HOW. The information contained in subframes 4 and 5, which has a large information volume, is transmitted after being divided into units called "pages". Then, the data to be transmitted in each of subframes 4 and 5 is divided into pages 1 to 25, and contents of the pages that differ depending on the frames are transmitted in order. Accordingly, 25 frames, that is, 12.5 minutes is required to transmit the contents of all the pages.

Note that, as is apparent from the above description, TOW is contained in all the subframes and can therefore be acquired at a timing that arrives every 6 seconds. On the other hand, WN is contained in subframe 1 and can therefore be acquired at a timing that arrives every 30 seconds.

Subsequently, individual operations executed when the satellite radio-controlled wristwatch 1 receives a satellite radio wave are described below with reference to FIGS. 1 and 2. The controller 13 executes a reception operation that is a series of operations of receiving the satellite radio wave by the satellite radio-controlled wristwatch 1 while controlling the timings of those individual operations.

(1) Continuous Operation Detection Operation

A continuous operation detection operation is an operation of detecting that the operating member has operated continuously for a predetermined operation reception time period. In the case of this embodiment, when the user carries out a long press operation of continuously pressing the push button 4*b* for a predetermined time period (for example, 2 seconds, hereinafter referred to as "operation reception time period"), the manual reception is carried out. Continuous operation is required for the user so as to prevent unintended operation due to an operation error.

The continuous operation detection operation is carried out by the controller 13 by detecting that the push button 4*b* has been pressed, and then detecting that the pressing has been continued for a predetermined time period.

(2) Activation Operation

An activation operation is an operation of turning on the switch 21 to supply power to the satellite radio wave reception unit 14 for activation thereof. This operation includes initialization of the high frequency circuit 11 and the decoder circuit 12 or the like, and takes a little time. The time point for ending the activation operation may be a time point at which a predetermined time period (for example, 0.6 seconds) has elapsed from the turning on of the switch 21 by the controller 13, or a time point at which the controller 13 has received a signal representing an activation end from the high frequency circuit 11 and the decoder circuit 12. A time period required for the activation operation is hereinafter referred to as "activation time period".

(3) Acquisition and Tracking Operation

An acquisition and tracking operation is an operation of acquiring and tracking a certain satellite radio wave by the satellite radio wave reception unit 14. The term. "acquisition" herein refers to an operation of extracting one of the signals multiplexed by CDMA, specifically, an operation of multiplying a received signal by a C/A code corresponding to one signal to extract a correlated signal. When a correlated signal cannot be obtained by the selected C/A code, a different C/A code is selected again to repeat the operation. At this time, when there are a plurality of correlated signals, a signal having the highest correlation may be selected. Further, satellite position information may be used to predict the satellite radio waves that may be received, to thereby limit the number of C/A codes to be selected and reduce the time required for the acquisition operation. Further, the term "tracking" herein refers to an operation of continuously extracting data by matching the phase of the carrier wave of the received signal and the phase of the C/A code contained in the received signal with the phase of the carrier wave of the selected C/A code and the phase of the code for decoding. Note that, it can be said from the meaning of the term "tracking" that the "tracking" is carried out while data is extracted from the satellite radio wave, but the "acquisition and tracking operation" herein refers to an operation from the start of acquiring the satellite radio wave to the head of TLM. This acquisition and tracking operation at least requires a time period of approximately 2 seconds, and the reception success probability increases by spending a longer time. On the other hand, when along time is spent on the acquisition and tracking operation, the time required for the entire reception operation increases to further increase the power consumption. The time period required for the acquisition and tracking operation is hereinafter referred to as "acquisition and tracking time period".

(4) Time Information Acquisition Operation

A time information acquisition operation is an operation of acquiring time information from the satellite radio wave received by the satellite radio wave reception unit 14. In this embodiment, an operation of receiving TLM and HOW and acquiring TOW contained in HOW corresponds to the time information acquisition operation. This operation requires a time period for transmitting TLM and HOW, that is, 60 bits×20 ms=1.2 seconds. Note that, when the reception of the parity at the end of HOW is omitted, 47 bits×20 ms=0.94 seconds are required in the shortest.

(5) Date Information Acquisition Operation

A date information acquisition operation is an operation of acquiring date information that is information relating to the date from the satellite radio wave received by the satellite radio wave reception unit 14. The date information herein refers to information other than time information (that is, hour, minute, and second) and is information for specifying the date on a calendar. In the case of the GPS, WN corresponds to the date information. In this embodiment, an operation of receiving WN transmitted after TLM and HOW to acquire WN corresponds to the date information acquisition operation. Note that, TOW contained in HOW can be simultaneously acquired at this time. Therefore, in this embodiment, the date information acquisition operation also serves as the time information acquisition operation.

(6) Time Information Transfer Operation

A time information transfer operation is an operation of transferring the acquired time information from the satellite radio wave reception unit 14 to the clock circuit 15. As described above, the operation frequency of the satellite radio wave reception unit 14 differs from the operation frequency of the controller 13, and hence the decoded information cannot be directly transferred from the satellite radio wave reception unit 14 to the clock circuit 15. Therefore, the controller 13 once stores the decoded information, and extracts only the necessary time information or time and date information to transfer the information to the clock circuit 15 at an appropriate timing.

(7) Reception Indication Operation

A reception indication operation is an operation of indicating that the reception operation is in progress by the reception indication member 7. In the case of this embodiment, the reception indication operation includes two kinds of indications described later, specifically, indication representing that the first reception operation is in progress ("QRX") and indication representing that the second reception operation is in progress ("RX").

(8) Reception Result Indication Operation

A reception result indication operation is an operation of indicating the reception result by the reception indication member 7. The reception result as used herein refers to any one of a case where the reception has succeeded and the internal time is adjusted (corresponding to "OK" indication) and a case where the reception has failed and the internal time is not adjusted (corresponding to "NG" indication).

(9) Previous Reception Result Indication Operation

A previous reception result indication operation is an operation of indicating the previous reception result by the reception indication member 7. The previous reception result as used herein refers to anyone of a case where the previous reception has succeeded and the internal time has been adjusted (corresponding to "OK" indication) and a case where the previous reception has failed and the internal time has not been adjusted (corresponding to "NG" indication).

The controller 13 executes the above-mentioned respective operations while controlling the timings of the respective operations depending on the conditions when the user presses the pushbutton 4*b*. Incidentally, as described above, a time information receivable time point that is a timing at which TOW is receivable (in the case of this embodiment, a timing at the time point of starting transmission of the subframe, at which TLM and HOW are received in the time information acquisition operation) arrives every 6 seconds. Then, if this time information receivable time point can be predicted, the acquisition and tracking time period and the activation time period, which are time periods required for the acquisition and tracking operation and the activation operation, respectively, and required to be executed before the time information acquisition operation, can be subtracted from the predicted time information receivable time point to obtain a timing corresponding to an activation time point. By starting the activation operation at this activation time point, the operation time of the satellite radio wave reception unit 14 can be minimized, which contributes to power saving.

On the other hand, as described in the "acquisition and tracking operation" section, the reception success probability increases when the acquisition and tracking time period is increased. In view of this, the controller 13 varies the acquisition and tracking time period depending on a predetermined condition as described below, to thereby balance the reception success probability and the operation time of the satellite radio wave reception unit 14. Specifically, the controller 13 prepares a plurality of time periods determined in advance as the acquisition and tracking time period, and selects one of the plurality of time periods depending on the predetermined condition. More specifically, the controller 13 prepares, as the acquisition and tracking time period, two kinds of time periods corresponding to a first acquisition and tracking time period (for example, 2 seconds) and a second acquisition and tracking time period longer than the first acquisition and tracking time period (for example, 5 seconds), and selects, depending on the predetermined condition, the first acquisition and tracking time period to carry out the first reception operation or the second acquisition and tracking time period to carry out the second reception operation. Note that, the method of varying the acquisition and tracking time period as described herein is merely an example. The acquisition and tracking time period may be selected from three or more kinds of acquisition and tracking time periods prepared in advance, or may be continuously varied.

In this embodiment, the controller 13 executes the following reception operations depending on the predetermined condition. Note that, the conditions for executing the respective reception operations are described later.

<First Reception Operation>

Figure 5A:
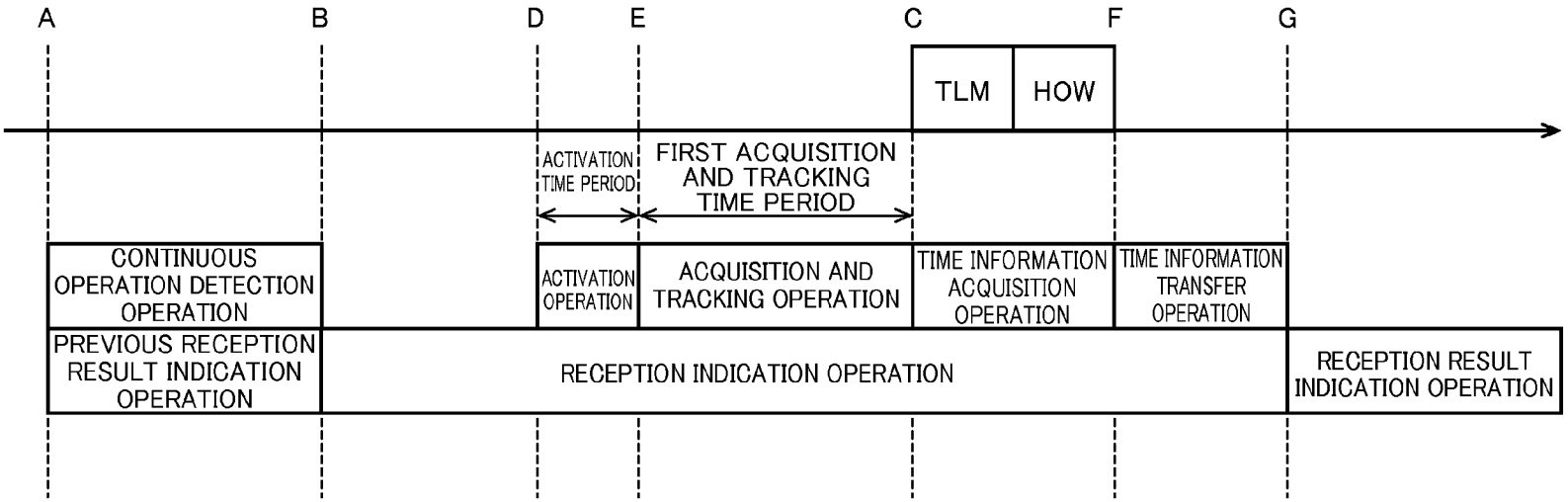
FIG. 5A is a time chart illustrating a first reception operation.

FIG. 5A is a time chart illustrating the first reception operation. In the chart, the horizontal axis represents the elapse of time. The controller 13 immediately starts the previous reception result indication operation at a time point A at which the push button 4*b* is pressed, and causes the reception indication member 7 to indicate the previous reception result.

After that, if the pushbutton 4*b* is pressed continuously for the operation reception time period, at a time point B at which the continuous operation detection operation is ended, the controller 13 selects the first acquisition and tracking time period as the acquisition and tracking time period, and predicts a time information receivable time point C, to thereby inversely calculate an activation time point D by subtracting the first acquisition and tracking time period and the activation time period from the time information receivable time point C. Note that, the time information receivable time point C arrives every 6 seconds, and hence the time information receivable time point C is selected so that the activation time point D arrives after the time point B and is closest to the time point B. Further, the controller 13 starts the reception indication operation at the time point B, and causes the reception indication member 7 to indicate that the reception is in progress. In this case, the first reception operation using the first acquisition and tracking time period is carried out, and hence the second hand serving as the reception indication member 7 points to "QRX" as the indication representing that the first reception operation is in progress.

The controller 13 waits for the arrival of the activation time point D to start the activation operation, and supplies power to the satellite radio wave reception unit 14. Further, the controller 13 immediately starts the acquisition and tracking operation at a time point E at which the activation operation is ended, and starts the time information acquisition operation at the time information receivable time point C that is a time point at which the acquisition and tracking operation is ended.

After that, the controller 13 acquires TOW contained in HOW, and starts the time information transfer operation at a time point F. Further, the controller 13 starts the reception result indication operation at a time point G at which the time information acquisition operation is ended. When the reception has succeeded, the controller 13 causes the reception indication member 7 (in this embodiment, the second hand) to point to the "OK" position indication 5. Note that, the reception result indication operation may start at the time point F without waiting for the transfer of the time information.

<Second Reception Operation>

Figure 5B:
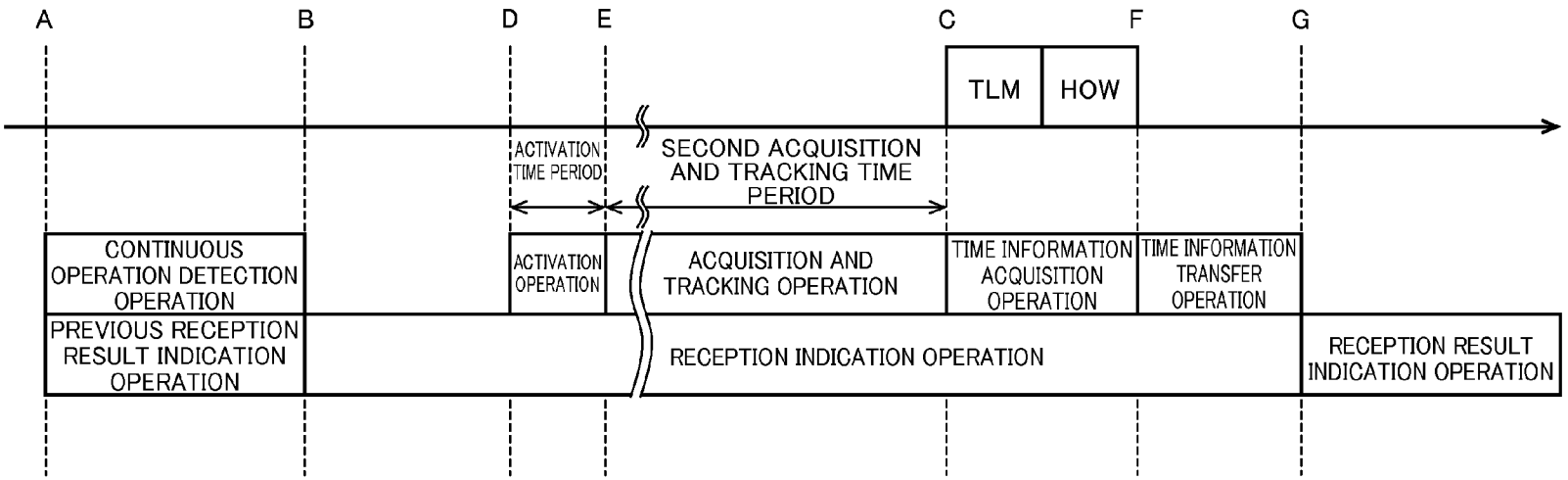
FIG. 5B is a time chart illustrating a second reception operation.

FIG. 5B is a time chart illustrating the second reception operation. Also in this chart, the horizontal axis represents the elapse of time. FIG. 5B illustrates the reception operation of the case of the manual reception, and hence the continuous operation detection operation and the previous reception result indication operation are illustrated. In the case of the automatic reception, however, those two operations are not executed, and hence the reception operation is started from the time point B.

In the second reception operation, the controller 13 selects, as the acquisition and tracking time period, the second acquisition and tracking time period that is a time period longer than the first acquisition and tracking time period. Further, in the second reception operation, during the reception indication operation, the reception indication member 7 points to "RX" that is an indication representing that the second reception operation is in progress. Other points are all the same as those in the first reception operation. Therefore, the time required for execution of the entire second reception operation becomes longer and the power consumption also increases than the case of the first reception operation, but the reception success probability is higher than that of the first reception operation.

Note that, when the reception indication member 7 indicates that the reception operation is in progress, it is not always necessary to clarify whether the first reception operation or the second reception operation is in progress, but in this embodiment, the user can know that the satellite radio-controlled wristwatch 1 is trying to receive the time information particularly at high speed when the reception indication member 7 points to "QRX" representing that the first reception operation is in progress.

<Third Reception Operation>

A third reception operation is executed when acquisition of WN is necessary. The acquisition of WN may be executed when the clock circuit 15 stops due to the decrease of a power supply voltage of the satellite radio-controlled wristwatch 1, or when a predetermined period (for example, 1 month) has elapsed from the previous WN reception.

Figure 5C:
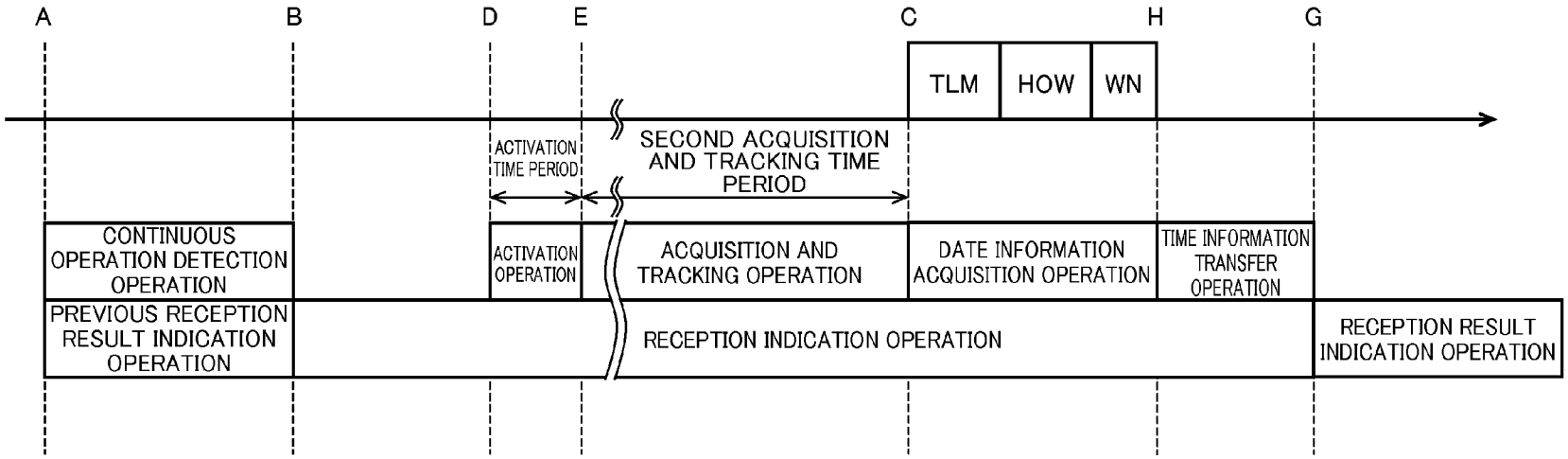
FIG. 5C is a time chart illustrating a third reception operation.

FIG. 5C is a time chart illustrating the third reception operation. Also in this chart, the horizontal axis represents the elapse of time. The operations in the third reception operation are similar to those in the second reception operation described above. The point that, in the case of the automatic reception, the continuous operation detection operation and the previous reception result indication operation illustrated in FIG. 5C are not executed, and the operation starts from the time point B is also the same.

Also in the third reception operation, the controller 13 selects, as the acquisition and tracking time period, the second acquisition and tracking time period. Therefore, in view of the point that the second acquisition and tracking time period is selected, the third reception operation can be said to be a variation of the second reception operation. Other points are all the same as those of the second reception operation until the time information receivable time point C arrives.

The controller 13 starts the date information acquisition operation from the time information receivable time point C to acquire TOW contained in HOW and WN. Note that, as the time information receivable time point C at this time, a time point at which WN can be received, that is, a time point of starting transmission of subframe 1 is selected. After that, the time information transfer operation is started at a time point H at which the WN acquisition is ended, and a reception result indication movement operation is carried out at the time point G at which the transfer of the time information is ended. Note that, similarly to the first reception operation and the second reception operation, the reception result indication operation may be started at the time point H.

Also in the third reception operation, the second acquisition and tracking time period is selected. Therefore, the time required for execution of the entire reception operation becomes longer and the power consumption also increases than the case of the first reception operation, but the reception success probability is higher than that of the first reception operation.

By the way, the time charts of the first to third reception operations in FIGS. 5A to 5C illustrate the case where the acquisition of the time information or the date information has succeeded in the time information acquisition operation or the date information acquisition operation. In regard to this point, when the acquisition of the time information or the date information has failed during the time information acquisition operation or the date information acquisition operation, the controller 13 of the satellite radio-controlled wristwatch 1 of this embodiment carries out control to attempt the acquisition again.

Figure 6A:
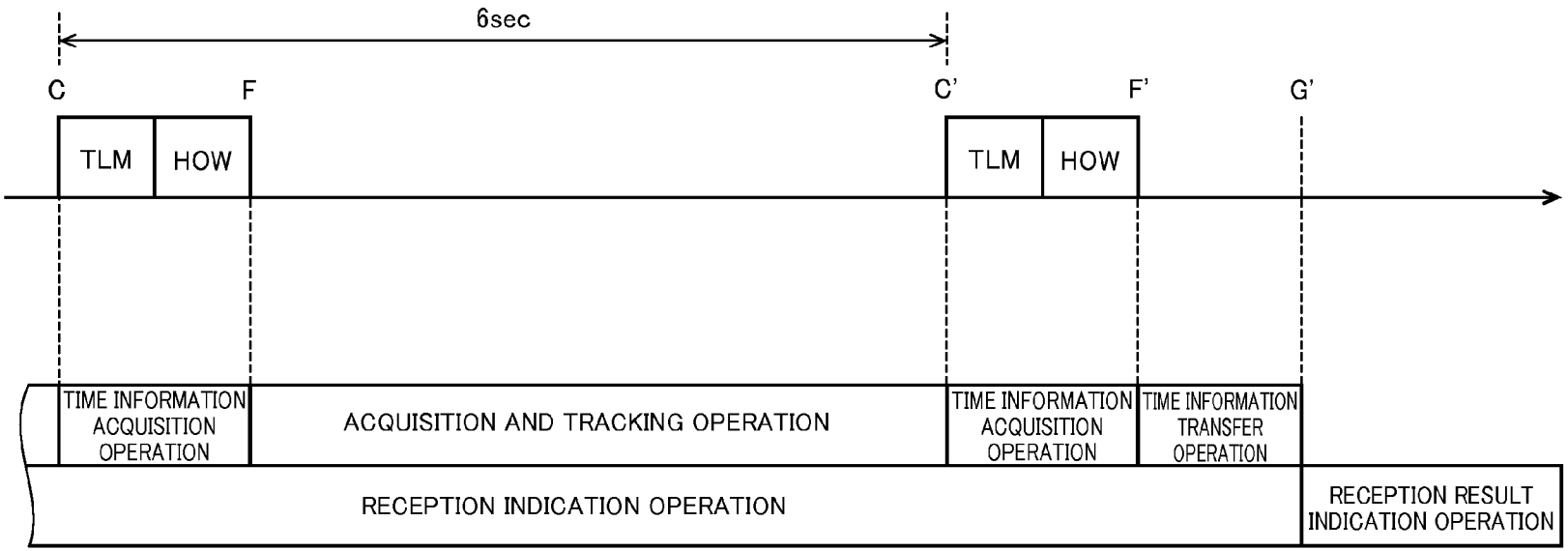
FIG. 6A is a time chart illustrating a first re-reception operation.
Figure 6B:
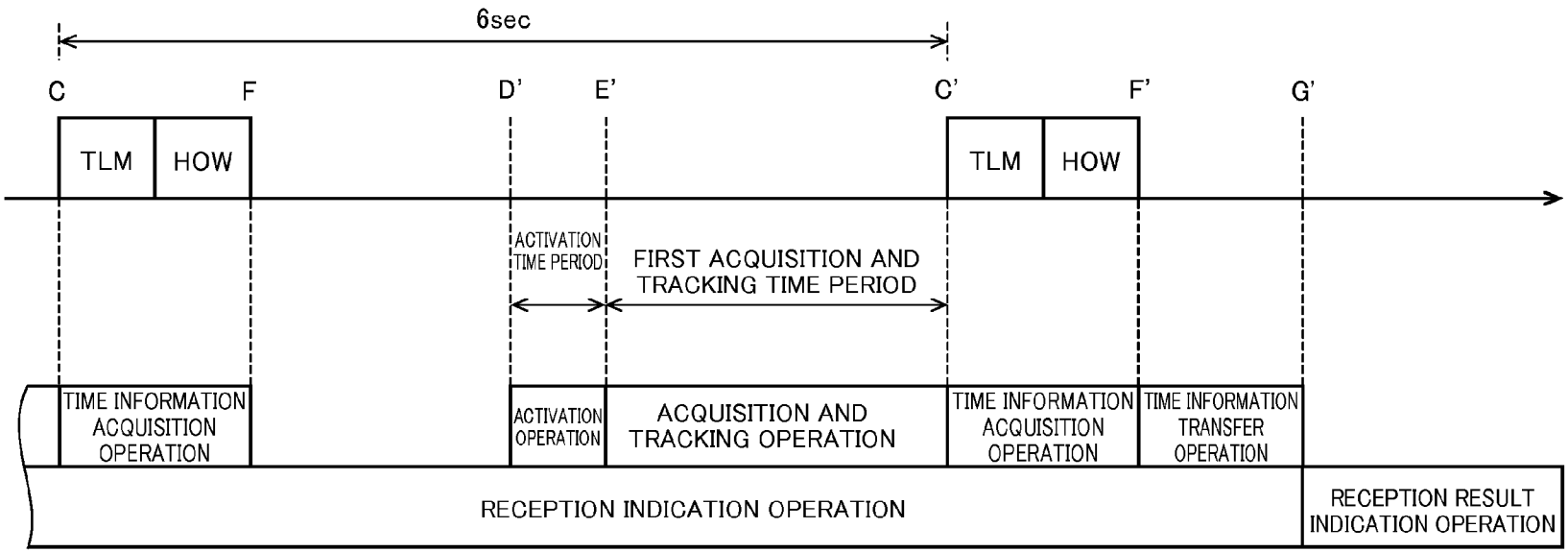
FIG. 6B is a time chart illustrating a first re-reception operation.
Figure 6C:
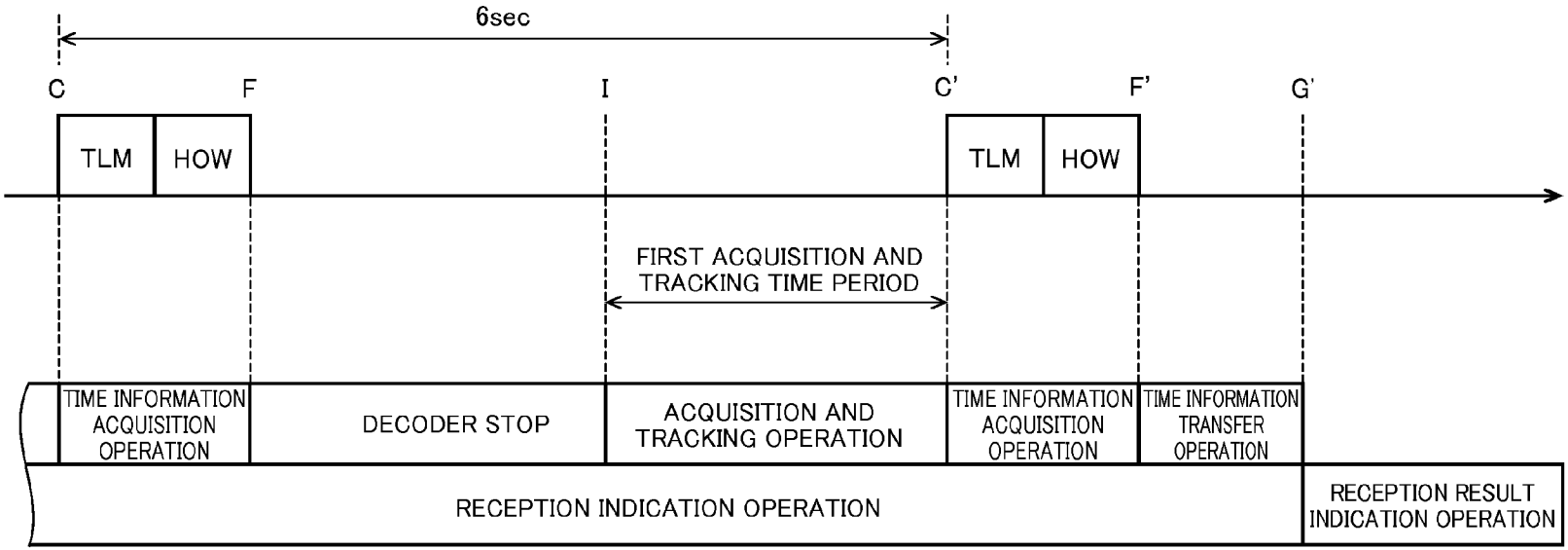
FIG. 6C is a time chart illustrating a first re-reception operation.

Several operations are conceivable as a reception operation executed by the controller 13 when the acquisition of the time information has failed (hereinafter this operation is referred to as "re-reception operation"), and any one of those operations may be adopted. FIGS. 6A to 6C are time charts each illustrating the reception operation executed when the acquisition of the time information during the time information acquisition operation has failed in the first reception operation. Note that, similar control is carried out also in the second reception operation and the third reception operation, and hence illustration and redundant description of the time charts representing the reception operations executed when the acquisition of the time information or the date information has failed during those reception operations are omitted. Note that, when the re-reception operation as described herein is executed in a case where the acquisition of the time information has failed in the first reception operation described above, the indication pointed by the reception indication member 7 may be changed from "QRX" to "RX". This is because the reception takes time in the case of the re-reception operation, and hence the increase of the reception speed felt by the user has already been lost.

FIG. 6A is a time chart illustrating a first re-reception operation. In the first re-reception operation, because the acquisition of the time information has failed at the time point F at which the first time information acquisition operation is ended, the controller 13 continuously supplies power to the satellite radio wave reception unit 14, and continues the acquisition and tracking operation until next time information receivable time point C'. Then, the second time information acquisition operation is started from the time information receivable time point C'. If the time information is accurately obtained, the time information is transferred through the time information transfer operation started from a time point F' at which the second time information acquisition operation is ended, and after that, at a time point G', the reception result (in this case, the "OK" indication) is indicated by the reception indication member 7 through the reception result indication operation. If the acquisition of the time information is failed even with the second time information acquisition operation, the reception result indication operation is started from the time point F', and the reception result (in this case, the "NG" indication) is indicated by the reception indication member 7. Then, the series of reception operations is ended. This first re-reception operation is continued without losing the result obtained by the first acquisition and tracking operation, and hence the reception success probability is high. On the other hand, the power consumption is large because the satellite radio wave reception unit 14 is operated for a long period of time.

FIG. 6B is a time chart illustrating a second re-reception operation. In the second re-reception operation, after the acquisition of the time information has failed at the time point F at which the first time information acquisition operation is ended, the controller 13 stops the supply of power to the satellite radio wave reception unit 14 to once end the operation of the satellite radio wave reception unit 14. Then, the re-activation operation is started from an activation time point D' inversely calculated from the next time information receivable time point C', in this case, from a time point obtained by subtracting the first acquisition and tracking time period and the activation time period from the next time information receivable time point C', followed by the subsequent acquisition and tracking operation. The second time information acquisition operation is started from the time information receivable time point C'. The subsequent operations are the same as those in the first re-reception operation. In the second re-reception operation, the satellite radio wave reception unit 14 is not operated longer than necessary, and hence the power consumption is smaller than that in the case of the first re-reception operation, but the result obtained by the first acquisition and tracking operation is lost. Note that, the acquisition and tracking time period in the second re-reception operation is not limited to the first acquisition and tracking time period adopted here. The second acquisition and tracking time period may by adopted considering the margin of the power supply voltage and the certainty of the reception in the re-reception operation, or a third acquisition and tracking time period that is longer than the first acquisition and tracking time period but shorter than the second acquisition and tracking time period may be used. The third acquisition and tracking time period may be variable depending on arbitrary conditions such as the margin of the power supply voltage and the reception intensity of the satellite radio wave in the first time information acquisition operation.

FIG. 6C is a time chart illustrating a third re-reception operation. In the third re-reception operation, after the acquisition of the time information has failed at the time point F at which the first time information acquisition operation is ended, the controller 13 continues the supply of power to the satellite radio wave reception unit 14, but stops the operation of the decoder circuit 12. Then, the operation of the decoder circuit 12 is restarted from an arbitrary time point I that is inversely calculated from the next time information receivable time point C', to thereby carry out the acquisition and tracking operation. The second time information acquisition operation is started from the time information receivable time point C'. The operations thereafter are similar to those in the first re-reception operation. This third re-reception operation is an intermediate re-reception operation between the first re-reception operation and the second re-reception operation. The power consumption is more suppressed than that in the first re-reception operation, and the result obtained by the first acquisition and tracking operation is not lost. The acquisition and tracking time period for the second acquisition and tracking operation may be set to, for example, the first acquisition and tracking time period, but because the result obtained by the first acquisition and tracking operation can be used, the time period may be shortened. Note that, when the third re-reception operation is adopted, the supply of power from the battery 17 to the high frequency circuit 11 and the decoder circuit 12 is not as illustrated in FIG. 2, and the controller 13 can control whether or not to supply power independently.

Figure 7:
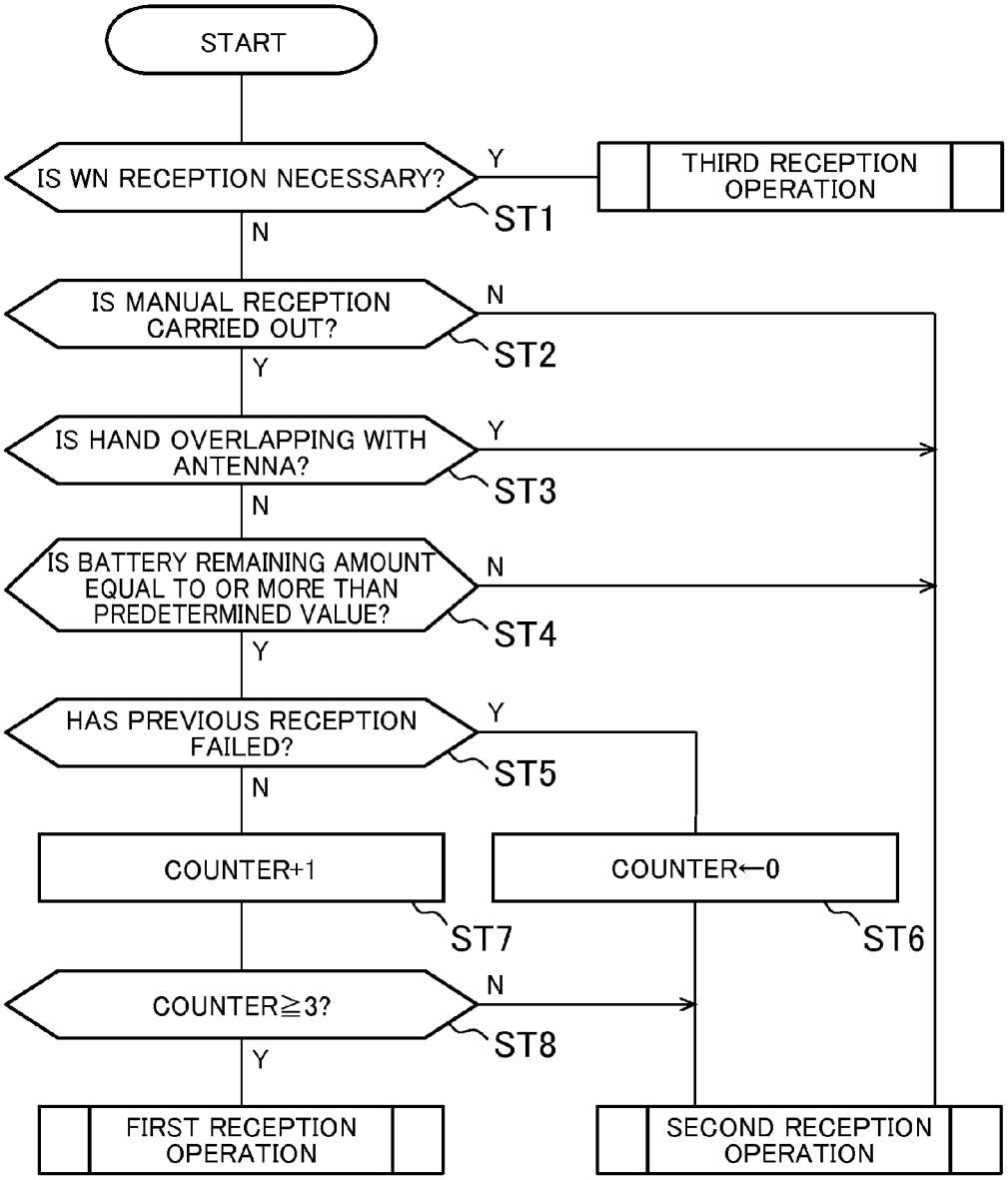
FIG. 7 is a flow chart illustrating an operation relating to reception of the satellite radio-controlled wristwatch according to the embodiment of the present invention.

FIG. 7 is a flow chart illustrating an operation relating to reception of the satellite radio-controlled wristwatch 1 of this embodiment. This flow chart broadly has the following meaning. Through determination based on the environment in which the satellite radio-controlled wristwatch 1 is placed, when the reception success probability is high and the probability that the re-reception operation is required and the power consumption increases is low, and in addition, when there is no particular reason to require reception success, the first reception operation is selected to reduce the reception time period, and otherwise the second reception operation (or the third reception operation) is selected to put priority on reception certainty.

The controller 13 first determines whether or not the reception of WN is necessary (Step ST1). When the reception of WN is necessary, the above-mentioned third reception operation is selected, and along therewith, the second acquisition and tracking time period is selected as the acquisition and tracking time period.

When the reception of WN is unnecessary, in subsequent Steps ST2 to ST8, the controller 13 selects any one of the first reception operation and the second reception operation based on various conditions relating to, for example, whether the automatic reception or the manual reception is carried out, the position of the hand, the power supply voltage, whether or not the power supply is charged, the reception history, whether or not the clock is manually adjusted, the attitude of the satellite radio-controlled wristwatch, the movement of the satellite radio-controlled wristwatch, the illuminance around the satellite radio-controlled wristwatch, and the position of the satellite radio-controlled wristwatch.

First, in Step ST2, determination is made based on whether the automatic reception or the manual reception is carried out. In this case, when the manual reception is not carried out (=automatic reception is carried out), the second reception operation is selected.

In Step ST3, determination is made based on the position of the hand. In this case, when the hands (such as the hour and minute hands) are located at positions at which the hands affect the reception performance, such as positions overlapping with the antenna 10 in plan view, the second reception operation is selected.

In Step ST4, determination is made based on the power supply voltage. In this case, when the remaining amount of the battery 17 is not equal to or more than a predetermined value, the second reception operation is selected.

In Steps ST5 to ST8, determination is made based on the reception history. In this case, when the reception by the reception operation in the latest attempt is not continuously succeeded a predetermined number of times (specifically, three times) or more, the second reception operation is selected. That is, in Step ST5, whether or not the previous reception has failed is determined, and when the reception has failed, the counter is reset to 0 in Step ST6, and the second reception operation is selected. When the previous reception has succeeded, 1 is added to the counter in Step ST7. Further, in Step ST8, when the counter is not equal to or more than 3, the second reception operation is selected. Note that, the previous reception as used herein may include the entire reception operation, or may mean only the reception by the first reception operation.

When the second reception operation is not selected up to here, the first reception operation is selected.

Note that, the conditions for the controller 13 to determine whether to select the first reception operation or the second reception operation are not limited to those described above. The conditions may be appropriately changed depending on the assumed specifications and use environment of the satellite radio-controlled wristwatch 1, the user base, or the like. Further, the user may select the conditions by himself/herself.

For example, the following conditions may be adopted in addition to the conditions given in FIG. 7. As a condition relating to the power supply voltage, whether or not the supply of power to the controller 13 is stopped due to the reduction in the power supply voltage may be adopted. Alternatively, as a condition relating to whether or not the power supply is charged, for example, whether or not the charging is carried out by the solar battery 18 or other methods may be adopted. Further, as a condition relating to the reception history, a condition relating to the index (such as a C/N ratio) representing the reception intensity of the satellite radio wave during previous reception or a condition relating to a Doppler frequency may be adopted, or a case where the reception history is deleted with the reset operation by the user on the satellite radio-controlled wristwatch 1 may be determined. Further, whether or not the time is manually adjusted may be adopted as the condition.

Further, an acceleration sensor or an angular velocity sensor may be mounted on the satellite radio-controlled wristwatch 1, and the attitude of the satellite radio-controlled wristwatch 1 or whether or not the satellite radio-controlled wristwatch 1 is moving may be adopted as the condition. This is because the satellite radio wave that is an ultra-high frequency wave has high straight traveling property, and hence it is predicted that the reception tends to succeed when the reception surface of the antenna of the satellite radio-controlled wristwatch 1 is directed vertically upward, and further the reception is susceptible to interference with an obstacle during movement. Similarly, an illuminance sensor may be mounted on the satellite radio-controlled wristwatch 1, and it may be determined that the reception tends to succeed when the illuminance around the satellite radio-controlled wristwatch 1 is high. This is because it is easier to receive the satellite radio wave when the satellite radio-controlled wristwatch 1 is located at a bright place such as outdoors in the daytime. Note that, instead of this illuminance sensor, the illuminance around the satellite radio-controlled wristwatch 1 may be evaluated based on the voltage generated by the solar battery 18.

Further, a condition relating to the position of the satellite radio-controlled wristwatch 1 may be used. As the condition relating to the position of the satellite radio-controlled wristwatch 1, the use of latitude is effective when a GPS satellite is utilized. This point is described. In the case of receiving the satellite radio wave from the artificial satellite, more advantageous reception is possible as the artificial satellite that is a source of the satellite radio wave has a larger elevation angle, that is, as the position of the artificial satellite is closer to the vertex, as viewed from the reception position, that is, the position of the satellite radio-controlled wristwatch 1. This is because, when the elevation angle of the artificial satellite is small, the satellite radio wave is blocked by the buildings and geography therearound, and further the distance between the reception position and the artificial satellite increases, which is considered to cause reduction in radio wave intensity. Therefore, a position capable of viewing a larger number of artificial satellites at a large elevation angle is advantageous in reception. In contrast, if a plurality of artificial satellites are arranged uniformly on the surface of the celestial sphere, there is no difference in advantage or disadvantage in reception at any of the positions on the ground, but the orbits of the GPS satellites are not uniform on the surface of the celestial sphere. This is because the orbits of the GPS satellites are selected so as to avoid positions above bipolar positions on the earth. Therefore, in a low-latitude area, there is a high possibility that the GPS satellite exists at a position with a large elevation angle, while the opposite is true in a high-latitude area. Therefore, in view of the example of this embodiment, for example, such a condition that the second reception operation is selected when the position of the satellite radio-controlled wristwatch 1 is equal to or more than 60 degrees north or south latitude may be used. In this case, the first reception operation is selected when the position of the satellite radio-controlled wristwatch 1 is less than 60 degrees north or south latitude, and when other conditions are simultaneously satisfied.

Further, when the satellite radio-controlled wristwatch 1 has a positioning function and includes a positioning unit for measuring the position of the satellite radio-controlled wristwatch 1, the latitude of the position of the satellite radio-controlled wristwatch 1 can be obtained based on the measurement result by the positioning unit. Alternatively, when the satellite radio-controlled wristwatch 1 has a world clock function or the like, and thus includes a position information reception unit for receiving, from the user, information relating to the position such as the name of the city, area, or country in which the satellite radio-controlled wristwatch 1 is used, the approximate latitude can be obtained based on the information relating to the position received by the position information reception unit.

Note that, by further using the orbit information of the artificial satellite in addition to the information on the position of the satellite radio-controlled wristwatch 1, the satellite radio-controlled wristwatch 1 may use a condition relating to the elevation angle of the artificial satellite, which is predicted based on the position of the satellite radio-controlled wristwatch 1. That is, when the satellite radio-controlled wristwatch 1 has its own position information, and also has orbit information of at least one GPS satellite through reception of the ephemeris or almanac contained in the GPS signal, the current elevation angle of the GPS satellite can be calculated. With use of this, for example, the following condition is conceivable. That is, when there are a predetermined number (for example, 1) or more of artificial satellites having an elevation angle of 30 degrees or more, the first reception operation is allowed, and otherwise the second reception operation is selected.

Further, conditions relating to the date, the time measuring mode (reception operation intended only for the time adjustment), the satellite number or whether the number is even or odd, the positioning mode (reception operation intended for measurement of the current position), whether or not the hands are moved by a motor, whether or not the fast-forward operation is carried out by a motor, and the like may be used. Note that, in view of the positioning mode, acquisition and reception of at least three satellite radio waves are necessary for positioning, which takes a long time. Therefore, it can be said that increasing the acquisition and tracking time period does not cause a significant problem.

Note that, the embodiment described above is merely an example for carrying out the invention, and the present invention is not limited to the specific shapes, arrangement, and configuration described in the embodiment. In particular, the arrangement, numbers, and designs of various members are matters to be appropriately designed by the person skilled in the art as necessary.

The invention claimed is:

1. A satellite radio-controlled wristwatch, comprising:

a satellite radio wave reception unit comprising an antenna for receiving a satellite radio wave, a high frequency circuit, and a decoder circuit;

a clock circuit for holding and counting an internal time; and a controller for controlling timings of at least:

an activation operation of supplying power to the satellite radio wave reception unit for activation thereof;

an acquisition and tracking operation of acquiring and tracking a certain satellite radio wave by the satellite radio wave reception unit; and a time information acquisition operation of acquiring time information from the satellite radio wave received by the satellite radio wave reception unit, the controller being configured to:

wait for an arrival of an activation time point, which is inversely calculated by subtracting an acquisition and tracking time period and an activation time period from a time information receivable time point that is predicted based on the internal time, and then start the activation operation; and vary the acquisition and tracking time period depending on a predetermined condition.

2. The satellite radio-controlled wristwatch according to claim 1, wherein the predetermined condition comprising at least one selected from the group consisting of whether automatic reception or manual reception is carried out, a position of a hand, a power supply voltage, whether or not a power supply is charged, a reception history, whether or not time is manually adjusted, an attitude of the satellite radio-controlled wristwatch, movement of the satellite radio-controlled wristwatch, illuminance around the satellite radio-controlled wristwatch, and a position of the satellite radio-controlled wristwatch.

3. The satellite radio-controlled wristwatch according to claim 1, wherein the controller selects one of a plurality of predetermined time periods as the acquisition and tracking time period depending on the predetermined condition.

4. The satellite radio-controlled wristwatch according to claim 3, wherein the controller selects, as the acquisition and tracking time period, any one of a first acquisition and tracking time period and a second acquisition and tracking time period longer than the first acquisition and tracking time period.

5. The satellite radio-controlled wristwatch according to claim 4, further comprising a reception indication member for indicating at least that a first reception operation is in progress and a second reception operation is in progress, wherein the controller causes the reception indication member to indicate that the first reception operation is in progress when the first acquisition and tracking time period is selected as the acquisition and tracking time period, and wherein the controller causes the reception indication member to indicate that the second reception operation is in progress when the second acquisition and tracking time period is selected as the acquisition and tracking time period.

6. The satellite radio-controlled wristwatch according to claim 4, wherein the controller selects the first acquisition and tracking time period when a user selects manual reception, a position of a hand is not overlapped with the antenna in a plan view, a power supply voltage is equal to or more than a predetermined threshold voltage, and reception has succeeded in each of a previous predetermined number of times.

7. The satellite radio-controlled wristwatch according to claim 1, further comprising:

a positioning unit for measuring a position of the satellite radio-controlled wristwatch, or a position information reception unit for receiving information relating to the position of the satellite radio-controlled wristwatch from a user, wherein the predetermined condition comprises a condition relating to latitude of the position of the satellite radio-controlled wristwatch.

8. The satellite radio-controlled wristwatch according to claim 7, wherein the predetermined condition further comprises a condition relating to an elevation angle of an artificial satellite, which is predicted based on the position of the satellite radio-controlled wristwatch.

* * * * *